United States Patent [19]

Kusunoki et al.

[11] Patent Number: 4,621,179

[45] Date of Patent: Nov. 4, 1986

[54] MICROWAVE HEATING APPARATUS

[75] Inventors: Shigeru Kusunoki; Tomotaka Nobue, both of Nara, Japan

[73] Assignee: Matsushita Electric Industrial Co., Ltd., Osaka, Japan

[21] Appl. No.: 486,283

[22] PCT Filed: Jul. 30, 1982

[86] PCT No.: PCT/JP82/00297

§ 371 Date: Mar. 29, 1983

§ 102(e) Date: Mar. 29, 1983

[87] PCT Pub. No.: WO83/00595

PCT Pub. Date: Feb. 17, 1983

[30] Foreign Application Priority Data

Aug. 7, 1981 [JP] Japan ..... 56-124332

[51] Int. Cl.[4] ..... H05B 6/64

[52] U.S. Cl. ..... 219/10.55 A; 219/10.55 F

[58] Field of Search ..... 219/10.55 R, 10.55 E, 219/10.55 F, 10.55 D, 10.55 A; 343/373

[56] References Cited

U.S. PATENT DOCUMENTS

| | | | |
|---|---|---|---|
| 3,549,849 | 12/1970 | Boehm | 219/10.55 F |
| 3,691,338 | 9/1972 | Chang | 219/10.55 R |
| 3,757,070 | 9/1973 | Van Koughnett et al. | 219/10.55 F |
| 3,843,862 | 10/1974 | Staats et al. | 219/10.55 F |
| 3,855,440 | 12/1974 | Staats et al. | 219/10.55 F |
| 3,867,607 | 2/1975 | Ohtani | 219/10.55 R |
| 3,953,702 | 4/1976 | Bickel | 219/10.55 R |
| 4,006,338 | 1/1977 | Dehn | 219/10.55 F |
| 4,088,970 | 5/1978 | Fassett et al. | 343/373 X |
| 4,093,840 | 6/1978 | Jean et al. | 219/10.55 F |
| 4,097,708 | 6/1978 | Bickel | 219/10.55 R |
| 4,415,789 | 11/1983 | Nobue et al. | 219/10.55 B |

FOREIGN PATENT DOCUMENTS

| | | |
|---|---|---|
| 644830 | 7/1964 | Belgium . |
| 0053841 | 6/1982 | European Pat. Off. . |
| 2536151 | 2/1976 | Fed. Rep. of Germany . |

*Primary Examiner*—Clarence L. Albritton
*Assistant Examiner*—M. M. Lateef
*Attorney, Agent, or Firm*—Wenderoth, Lind & Ponack

[57] ABSTRACT

A microwave heating apparatus is arranged such that the output from a single semiconductor oscillator is divided into two parts by a power divider and the parts are amplified by a pair of respective amplifiers and the amplified parts are fed into a heating chamber by two antennas, the phase of the two microwaves parts being adjusted so as to combine their power in the heating chamber.

4 Claims, 3 Drawing Figures

MICROWAVE HEATING APPARATUS

BACKGROUND OF THE INVENTION

1. Field of the Invention

This invention relates to a microwave heating apparatus wherein the output from a semiconductor microwave oscillator is divided into two parts by a power distributor and the parts are respectively amplified by power amplifiers and microwaves are fed into a heating chamber by two antennas. The invention is intended to control the phase of microwaves to effect the combination of power in the heating chamber.

2. Description of the Prior Art

Such a conventional apparatus, as shown in FIG. 1, distributes the output from a semiconductor oscillator 1, i.e., evenly distributes the output by a divider 2 from a terminal a to terminals b and c and then amplifies the divided outputs respectively amplifying the parts by semiconductor amplifiers 3 and 4, and then combines the amplified outputs with a power combiner 5, and feeds the resultant output to the heating chamber by a single antenna $A_1$. The signals input to the terminals e and f are combined and delivered from the terminal g. The terminals d and h are interconnected and grounded.

This arrangement, however, has drawbacks such as requiring a high power combiner 5 which produces high power losses.

SUMMARY OF THE INVENTION

Accordingly, the invention provides an arrangement which divides the output from a single semiconductor power oscillator into two parts by a power divider, respectively amplifies the two parts by means of power amplifiers, and feeds the amplified outputs to two antennas which in turn feed into a heating chamber serving as an microwave resonator, said heating chamber also serving as a power combiner, thereby making the arrangement highly efficient and inexpensive. An embodiment of the invention will now be described with reference to the drawings.

DESCRIPTION OF THE PREFERRED EMBODIMENT

Figure 1:
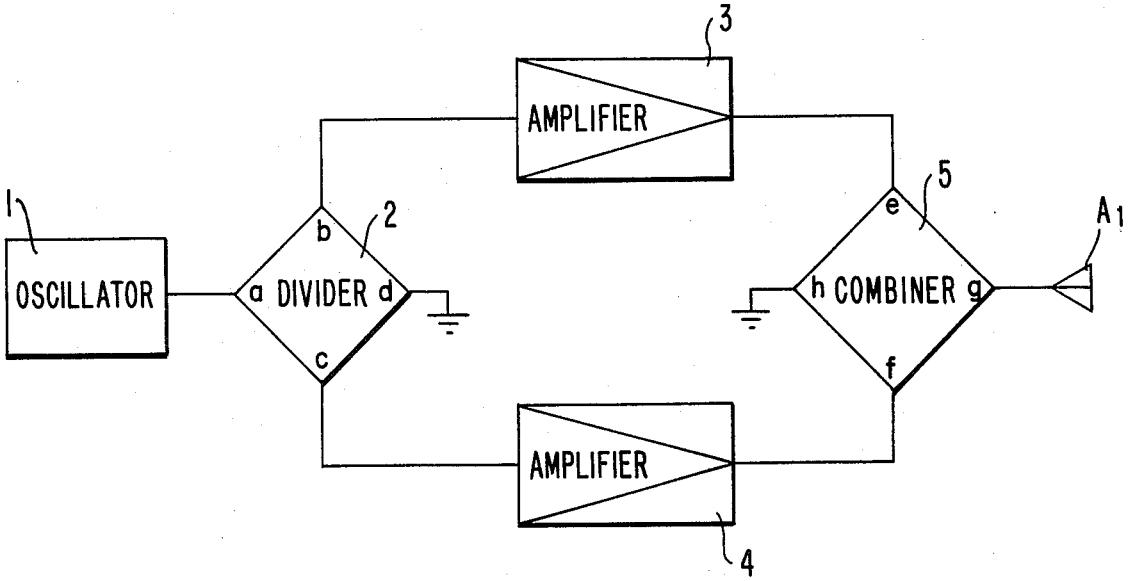
FIG. 1. (PRIOR ART)
FIG. 1 is a block diagram showing a conventional semiconductor microwave generator.
Figure 2:
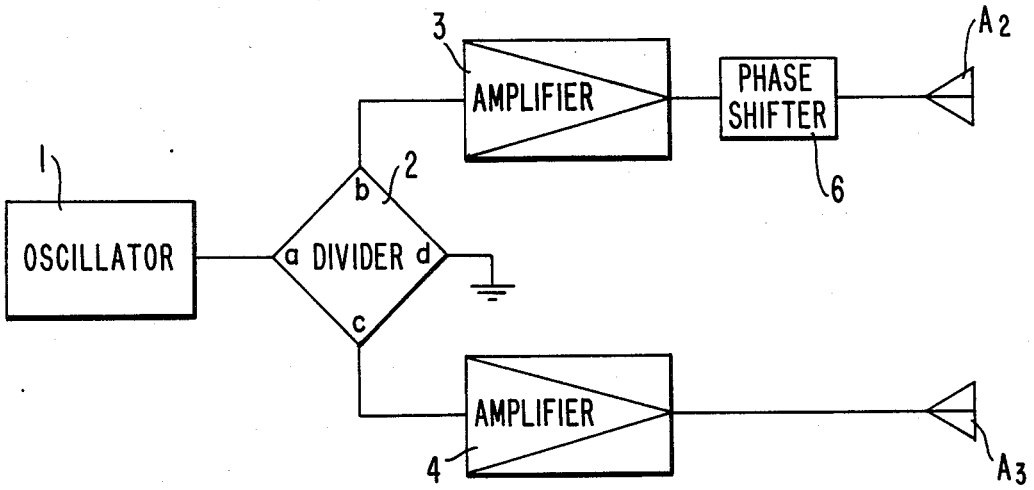
FIG. 2 is a block diagram showing a microwave heating apparatus according to this invention.

In FIG. 2 the power from a semiconductor microwave oscillator 1 enters the terminal a of a divider 2 and is equally divided and output from the terminals b and c. The d terminal is grounded termination. In addition, the microwave output from terminals b and c are, generally, in phase and 180° out of phase with the microwave input to terminal a. The outputs from the distributor 2 are amplified by semiconductor amplifiers 3 and 4 and fed to two antennas $A_2$ and $A_3$. One of the two amplifiers has a phase shifter 6 connected thereto, as required for phase shift, in relation to a heater chamber to be described below.

Figure 3:
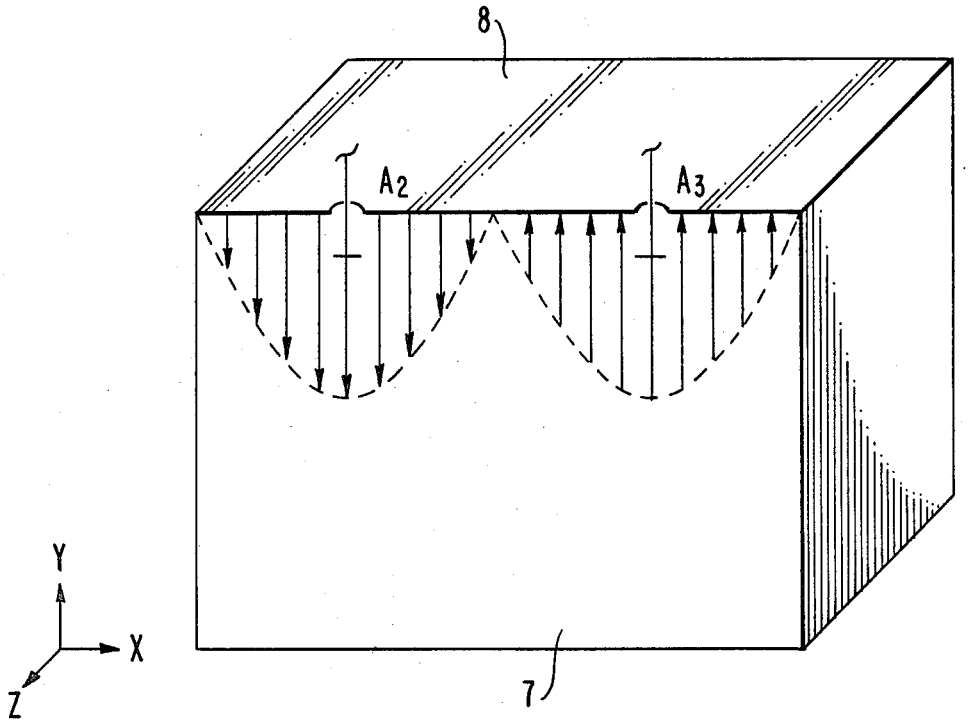
FIG. 3 shows the positional relationship between antennas and a heating chamber in the principal portion of the apparatus.

FIG. 3 shows the relationship between the heating chamber and the antennas. The heating chamber 7 is defined by metal walls and serves as a cavity resonator with respect to microwaves. The figure shows an example of a TE 201 standing wave mode (2, 0, 1), That is, standing wave electric fields change in intensity by 2, 0 and 1 in the directions of x, y and z, respectively. In this case, the antennas $A_2$ and $A_3$ are located at $\frac{1}{4}$ and $\frac{3}{4}$ positions in the x direction and at the middle in the z direction on the x-z plane, whereby microwave oscillation is effected in the highest intensity region of electric field in the standing wave mode (2, 0, 1), so that microwaves can be efficiently fed into the heating chamber.

The outputs from the antennas are 180° out of phase with each other because of the relationship to the time phase of the standing wave mode.

Let $\theta$ be said phase, $\beta$ be the propagation constant and 1 be the distance from the power amplifier to the antenna. Then, $\theta=\beta_1$. In order to obtain a phase shift of 180°, the power is fed to one antenna with the use of a phase shifter 6 if the distributor 2 provides two outputs which are in phase but without the use of a phase shifter if the two outputs are 180° out of phase.

As described above, according to the present invention, since the combination of power is possible in the heating chamber cavity even in the absence of a power combiner, it is possible to avoid the more than 10% power loss caused when a power combiner is used.

While the combination of high power is difficult to achieve in the case of strip wires often used in semiconductor power systems because of problems of heat dissipation and electric discharge, the invention basically solves these problems.

Furthermore, since antennas are provided on a single wall surface, as compared with an arrangement providing antennas on two separate wall surfaces, there are merits in that the ineffective volume of the heating chamber can be reduced and that the arrangement of the microwave lines for feeding power to the respective antenna is planar and simple.

We claim:

1. A microwave heating apparatus using a semiconductor microwave generator wherein the output from a single semiconductor oscillator is branched by a power distributor, and the branched power parts are respectively individually amplified by respective semiconductor amplifiers, the amplified power parts being fed into a heating chamber by two antennas provided on a single wall surface of the heating chamber via a phase shifting means such that they are 180° out of phase with each other.

2. A microwave heating apparatus as set forth in claim 1, wherein an in-phase distributor is used as said power distributor, and wherein said phase shifting means includes a phase shifter for phase-shifting microwaves by 180°, said phase shifter being installed in one of two microwave lines leading to the two antennas from their respective amplifiers.

3. A microwave heating apparatus as set forth in claim 1, wherein said power distributor and phase shifting means comprise a single means which outputs a pair of microwave outputs whose phases differ by 180°.

4. A microwave heating apparatus as set forth in claim 1, wherein the resonance mode in the heating chamber has a TE standing wave (2, 0, 1) and said two antennas are installed at $\frac{1}{4}$ and $\frac{3}{4}$ positions, respectively, in the x direction and at the middle in the z direction on the x-z wall surface.

* * * * *